US008279148B2

(12) United States Patent
Choi et al.

(10) Patent No.: US 8,279,148 B2
(45) Date of Patent: Oct. 2, 2012

(54) LCD AND DRIVE METHOD THEREOF

(75) Inventors: Jin Chul Choi, Paju si (KR); Sun Young Kim, Hwaseong-si (KR)

(73) Assignee: LG Display Co., Ltd., Seoul (KR)

( * ) Notice: Subject to any disclaimer, the term of this patent is extended or adjusted under 35 U.S.C. 154(b) by 1075 days.

(21) Appl. No.: 11/963,328

(22) Filed: Dec. 21, 2007

(65) Prior Publication Data

US 2008/0150865 A1 Jun. 26, 2008

(51) Int. Cl.
*G09G 3/36* (2006.01)

(52) U.S. Cl. ..... 345/89; 359/237

(58) Field of Classification Search ..... 345/690–696, 345/3.1–3.3, 38, 50–54, 87–101; 359/237
See application file for complete search history.

(56) References Cited

U.S. PATENT DOCUMENTS

2002/0033900 A1* 3/2002 Honma et al. ..... 348/581
2005/0231650 A1* 10/2005 Kobori et al. ..... 348/743
2005/0258997 A1* 11/2005 Kim et al. ..... 341/155
2006/0170616 A1* 8/2006 Hirayama et al. ..... 345/32
2006/0176256 A1* 8/2006 Yen et al. ..... 345/88

* cited by examiner

*Primary Examiner* — Amare Mengistu
*Assistant Examiner* — Vinh Lam
(74) *Attorney, Agent, or Firm* — Birch, Stewart, Kolasch & Birch, LLP

(57) ABSTRACT

This invention relates to a liquid crystal display device and its driving method for improving a visual picture quality. A liquid crystal display device according to an embodiment includes a liquid crystal display panel where plural pixels composed of sub-pixels arranged in a fixed pattern are arranged by the unit of one horizontal line; a timing controller for controlling the gray level realization of digital data inputted from a system; and a data drive circuit that differently realigns a data pattern of the digital data by the unit of one horizontal line for each k horizontal period, that converts the digital data of the realigned data pattern into analog data voltages, and that makes the analog data voltages, which are buffered in accord with the realigned data pattern, in accord with an arrangement pattern of the sub-pixels constituting each pixel to supply the analog data voltages to each pixel.

9 Claims, 9 Drawing Sheets

RGB DATA
CONTROLLER
221
R1,G1,B1 or B1,R1,G1 or G1,B1,R1
Ri,Gi,Bi or Bi,Ri,Gi or Gi,Bi,Ri
220
SHIFT REGISTER
222
SSC
SSP
223
LATCH PART
FIRST D/A CONVERTER
SECOND D/A CONVERTER
THIRD D/A CONVERTER
m−2th D/A CONVERTER
m−1th D/A CONVERTER
mth D/A CONVERTER
224−1
224−2
224−3
224−(m−2)
224−(m−1)
224−m
225−1
225−2
225−3
225−(m−2)
225−(m−1)
225−m
228−1
228−2
228−3
228−(m−2)
228−(m−1)
228−m
227−1
227−2
227−3
227−(m−2)
227−(m−1)
227−m
DL1
DL2
DL3
DL(m−2)
DL(m−1)
DLm
GSP
OUTPUT CONTROLLER
226

LCD AND DRIVE METHOD THEREOF

This application claims the priority benefit of the Korean Patent Application No. 10-2006-0133692 filed on Dec. 26, 2006, which is hereby incorporated by reference.

BACKGROUND OF THE INVENTION

1. Field of the Invention

The present invention relates to a liquid crystal display device, and more particularly to a liquid crystal display device and the driving method thereof that is adaptive for improving a visual picture quality by changing the buffering location of analog data voltages, which are supplied by the unit of one horizontal line, for each fixed period.

2. Description of the Related Art

A liquid crystal display device controls the light transmittance of liquid crystal cells in accordance with video signals to display a picture. And, an active matrix type liquid crystal display device where a switching device is formed for each liquid crystal cell is advantageous in realizing motion pictures because the switching device can be actively controlled. The switching device used in the active matrix type liquid crystal display device is mainly a thin film transistor (hereinafter, referred to as "TFT"), as in FIG. 1.

Referring to FIG. 1, an active matrix type liquid crystal display device converts digital input data into analog data voltages on the basis of a gamma reference voltage to supply to data lines DL, and at the same time, supplies scan pulses to gate lines GL to charge liquid crystal cells Clc therewith.

The TFT includes a gate electrode connected to the gate line GL, a source electrode connected to the data line DL and a drain electrode connected to one electrode of a storage capacitor Cst and a pixel electrode of the liquid crystal cell Clc.

Common voltages Vcom are supplied to a common electrode of the liquid crystal cell Clc.

When the TFT is turned on, the storage capacitor Cst is charged with the data voltages applied from the data line DL, to fixedly maintain the voltage of the liquid crystal cell Clc.

If the scan pulses are applied to the gate line GL, the TFT is turned on to form a channel between the source electrode and the drain electrode, thereby supplying the voltage of the data line DL to the pixel electrode of the liquid crystal cell Clc. At this moment, the liquid crystal molecules of the liquid crystal cell Clc are changed in arrangement by the electric field between the pixel electrode and the common electrode, thereby modulating the incident light.

The liquid crystal display device of the related art having the pixels with such a structure includes a data drive circuit which converts the digital ROB data supplied from a system into analog RGB data voltages to supply to sub-pixels.

Herein, a data drive circuit 100, as shown in FIG. 2, includes a plurality of output buffers 110-1 to **110-*m* which buffer the converted analog RGB data voltages to supply to each sub-pixel. Herein, the output terminals of the output buffers 110-1 to 110-*m* are connected to correspond to a plurality of output channels 120-1 to 120-*m*** in a one-on-one relationship, respectively.

And, the output channels 120-1 to **120-*m* correspond to the data lines DL1 to DLm in the one-to-one relationship, respectively. To the data lines DL1** to DLm are connected the sub-pixels which are disposed on the same vertical line Each pixel is formed of three sub-pixels, i.e., R sub-pixel, G sub-pixel and B sub-pixel, which are disposed on the same horizontal line.

The analog data voltages buffered by the output buffers 110-1 to **110-*m* are supplied to each sub-pixel through the pertinent data line for each one horizontal line. For example, the analog R data voltage buffered by the output buffer 110-1 for each one horizontal period is supplied to the R sub pixel connected to the data line DL1** for each one horizontal line.

Because the analog data voltage is supplied to each pixel through the output buffers 110-1 to **110-*m*, if an offset error is generated in the first output buffer 110-1 such that the gray level of the R data supplied through the first data line DL1 becomes higher or lower than a desired gray level in the buffering process of the output buffer 110-1 then the gray level realized in the sub-pixels on the same vertical line connected to the first data line DL1 becomes darker or brighter than the gray level realized in other sub-pixels of the pixel to which itself is belong, as shown in FIG. 3**.

As in FIG. 3, in case that the vertical line is divided for each sub-pixel, if the gray level realized on one vertical line is continuously displayed to be darker or brighter than the gray level on another vertical line, then a user visually feels the gray level which is realized abnormally on the first vertical line.

That is to say, the liquid crystal display device of the related art has a problem in that the picture quality visually felt by the user becomes worse, as described above in reference to FIG. 3, if the offset error is generated in at least any one output buffer of the output buffers 110-1 to **110-*m***.

SUMMARY OF THE INVENTION

Accordingly, it is an object of the present invention to provide a liquid crystal display device and the driving method thereof that is adaptive for improving a visual picture quality by changing the buffering location of analog data voltages, which are supplied by the unit of one horizontal line, for each fixed period.

In order to achieve these and other objects of the invention, a liquid crystal display device according to an aspect of the present invention includes: a liquid crystal display panel where a plurality of pixels composed of sub-pixels arranged in a fixed pattern are arranged by the unit of one horizontal line; a timing controller for controlling the gray level realization of digital data inputted from a system; and a data drive circuit that differently realigns a data pattern of the digital data, which are inputted from the timing controller, by the unit of one horizontal line for each k horizontal period under the control of the timing controller, that converts the digital data of the realigned data pattern into analog data voltages to buffer the analog data voltages and that makes the analog data voltages, which are buffered in accord with the realigned data pattern, in accord with an arrangement pattern of the sub-pixels constituting each pixel to supply the analog data voltages to each pixel.

In the liquid crystal display device, the data drive circuit includes: a controller that differently realigns the data pattern of the digital data, which are inputted from the timing controller, by the unit of one horizontal line for each k horizontal period; a latch part that latches the digital data of the pattern realigned by the controller; first to $m^{th}$ A/D converters that convert the digital data, which are latched in accord with the data pattern realigned by the controller, into the analog data voltages; first to $m^{th}$ output buffers that buffer the analog data voltages which are converted in accord with the data pattern realigned by the controller; an output controller that controls the analog data voltages, which are buffered in accord with the data pattern realigned by the controller, to be outputted in accord with an arrangement pattern of the sub-pixels which constitute each pixel, in response to gate start pulses from the timing controller; and first to $m^{th}$ switches that supply the analog data voltages, which are buffered in accord with the data pattern realigned by the controller, to each pixel by making the analog data voltages in accord with the arrangement pattern of the sub-pixels which constitute each pixel, under the control of the output controller.

In the liquid crystal display device, the controller differently realigns the data pattern of the digital RGB data, which are inputted from the timing controller, by the unit of three horizontal lines for each horizontal period.

In the liquid crystal display device, the controller realigns the data pattern of the digital RGB data, which are inputted from the timing controller, to an RGB pattern, a BRG pattern or a GBR pattern by the unit of three horizontal lines for each horizontal period.

In the liquid crystal display device, in case that the data pattern of the digital RGB data is aligned to the RGB pattern by the controller, the first to $m^{th}$ output buffers buffer the analog data voltages which are converted in accord with the RGB pattern.

In the liquid crystal display device, the first to $m^{th}$ switches maintain the RGB pattern of the analog data voltages, which are buffered in accord with the RGB pattern, to supply to each pixel.

In the liquid crystal display device, in case that the data pattern of the digital RGB data is aligned to the BRG pattern by the controller, the first to $m^{th}$ output buffers buffer the analog data voltages which are converted in accord with the BRG pattern.

In the liquid crystal display device, the first to $m^{th}$ switches change the analog data voltages, which are buffered in accord with the BRG pattern, to the ROB pattern of the sub-pixels constituting each pixel, to supply to each pixel.

In the liquid crystal display device, in case that the data pattern of the digital RGB data is aligned to the GBR pattern by the controller, the first to $m^{th}$ output buffers buffer the analog data voltages which are converted in accord with the GBR pattern.

In the liquid crystal display device, the first to $m^{th}$ switches change the analog data voltages, which are buffered in accord with the GBR pattern, to the RGB pattern of the sub-pixels constituting each pixel, to supply to each pixel.

A data drive circuit of a liquid crystal display device according to another aspect of the present invention includes: a controller that differently realigns a data pattern of digital data, which are inputted thereto, by the unit of one horizontal line for each k horizontal period; a latch part that latches the digital data of the pattern realigned by the controller; first to $m^{th}$ A/D converters that convert the digital data, which are latched in accord with the data pattern realigned by the controller, into the analog data voltages; first to $m^{th}$ output buffers that buffer the analog data voltages which are converted in accord with the data pattern realigned by the controller; an output controller that controls the analog data voltages, which are buffered in accord with the data pattern realigned by the controller, to be outputted in accord with an arrangement pattern of the sub-pixels which constitute each pixel; and first to $m^{th}$ switches that supply the analog data voltages, the controller, to each pixel by making the analog data voltages in accord with the arrangement pattern of the sub-pixels which constitute each pixel, under the control of the output controller.

In the data drive circuit, the controller differently realigns the data pattern of the digital RGB data, which are inputted from the timing controller, by the unit of three horizontal lines for each horizontal period.

In the data drive circuit, the controller realigns the data pattern of the inputted digital RGB data to an RGB pattern, a BRG pattern or a GBR pattern by the unit of three horizontal lines for each horizontal period.

In the data drive circuit in case that the data pattern of the digital RGB data is aligned to the RGB pattern by the controller, the first to $m^{th}$ output buffers buffer the analog data voltages which are converted in accord with the RGB pattern.

In the data drive circuit, the first to $m^{th}$ switches maintain the RGB pattern of the analog data voltages, which are buffered in accord with the RGB pattern, to supply to each pixel.

In the data drive circuit, in case that the data pattern of the digital RGB data is aligned to the BRG pattern by the controller, the first to $m^{th}$ output buffers buffer the analog data voltages which are converted in accord with the BRG pattern.

In the data drive circuit, the first to $m^{th}$ switches change the analog data voltages, which are buffered in accord with the BRG pattern, to the RGB pattern of the sub-pixels constituting each pixel, to supply to each pixel.

In the data drive circuit, in case that the data pattern of the digital RGB data is aligned to the GBR pattern by the controller, the first to $m^{th}$ output buffers buffer the analog data voltages which are converted in accord with the GBR pattern.

In the data drive circuit, the first to $m^{th}$ switches change the analog data voltages, which are buffered in accord with the GBR pattern, to the RGB pattern of the sub-pixels constituting each pixel, to supply to each pixel.

A driving method of a liquid crystal display device according to still another aspect of the present invention includes: differently realigning a data pattern of inputted digital data by the unit of one horizontal line for each k horizontal period; latching the digital data of the realigned pattern; converting the digital data, which are latched in accord with the realigned data pattern, into analog data voltages; buffering the analog data voltages which are converted in accord with the realigned data pattern; and supplying the analog data voltages, which are buffered in accord with the realigned data pattern, to each pixel by making the analog data voltages in accord with an arrangement pattern of sub-pixels which constitute each pixel.

In the driving method, when realigning, the data pattern of the inputted digital RGB data is differently realigned by the unit of three horizontal lines for each one horizontal period.

In the driving method, when realigning, the data pattern of the inputted digital RGB data is realigned to an RGB pattern, a BRG pattern or a GBR pattern by the unit of three horizontal lines for each horizontal period.

In the driving method, in case that the data pattern of the inputted digital RGB data is aligned to the RGB pattern, the analog data voltages, which are converted in accord with the aligned RGB pattern, are buffered.

In the driving method, the RGB pattern of the analog data voltages, which are buffered in accord with the aligned RGB pattern, is maintained to be supplied to each pixel.

In the driving method, in case that the data pattern of the inputted digital RGB data is aligned to the BRG pattern, the analog data voltages, which are converted in accord with the aligned BRG pattern, are buffered.

In the driving method, the analog data voltages, which are buffered in accord with the aligned BRG pattern, are changed to the RGB pattern of the sub-pixels constituting each pixel, to be supplied to each pixel.

In the driving method, in case that the data pattern of the inputted digital RGB data is aligned to the GBR pattern, the analog data voltages, which are converted in accord with the aligned GBR pattern, are buffered.

In the driving method, the analog data voltages, which are buffered in accord with the GBR pattern, are changed to the RGB pattern of the sub-pixels constituting each pixel, to be supplied to each pixel.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 4:
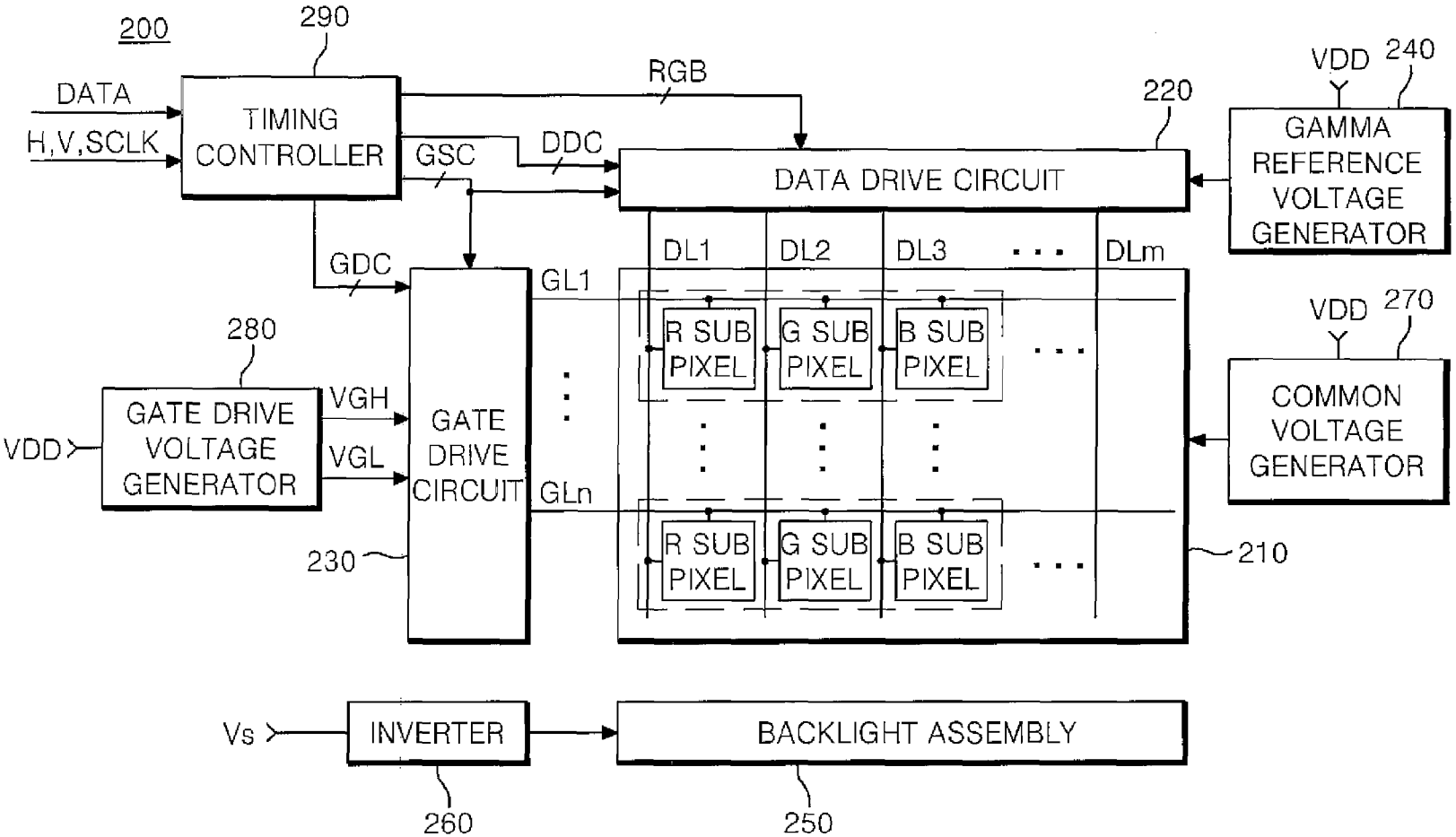
FIG. 4 is a schematic diagram of a liquid crystal display device according to an embodiment of the present invention.

FIG. 4 is a schematic diagram of a liquid crystal display device according to an embodiment of the present invention.

Referring to FIG. 4, a liquid crystal display device 200 of the present invention includes a liquid crystal display panel 200; a data drive circuit 220; a gate drive circuit 230; a gamma reference voltage generator 240; a backlight assembly 250; an inverter 260; a common voltage generator 270; a gate drive voltage generator 280; and a timing controller 290. Herein, the data drive circuit 220 supplies data to data lines DL1 to DLm of the liquid crystal display panel 210. The gate drive circuit 230 supplies scan pulses to gate lines GL1 to GLn of the liquid crystal display panel 210. The gamma reference voltage generator 240 generates gamma reference voltages to supply to the data drive circuit 220. The backlight assembly 250 irradiates light onto the liquid crystal display panel 210. The inverter 260 applies AC voltages and currents to the backlight assembly 250. The common voltage generator 270 generates common voltages Vcom to supply to the common electrode of the liquid crystal cell Clc of the liquid crystal display panel 210. The gate drive voltage generator 280 generates gate high voltages VGH and gate low voltages VGL to supply to the gate drive circuit 230. The timing controller 290 controls the data drive circuit 220 and the gate drive circuit 230.

The liquid crystal display panel 210 has liquid crystals deposited between two glass substrates. Data lines DL1 to DLm and gate lines GL1 to GLn perpendicularly cross each other on the lower glass substrate of the liquid crystal display panel 210. Sub-pixels are formed in the cell areas defined by the crossing of the data lines DL1 to DLm and the gate lines GL1 to GLn. A TFT is formed in the sub-pixel. The TFT supplies data of the data lines DL1 to DLm to the liquid crystal cell Clc in response to scan pulses. A gate electrode of the TFT is connected to the gate lines GL1 to GLn, a source electrode of the TFT is connected to the data lines DL1 to DLm. And, a drain electrode of the TFT is connected to a storage capacitor Cst and a pixel electrode of the liquid crystal cell Clc.

The TFT is turned on in response to the scan pulses supplied to the gate terminal through the gate line, which is connected to its own gate terminal, among the gate lines GL1 to GLn. When the TFT is turned on, the video data of the data line, which is connected to the drain terminal of the TFT, among the data lines DL1 to DLm are supplied to the pixel electrode of the liquid crystal cell Clc.

The data drive circuit 220 converts the digital RGC data, which are inputted through the timing controller 290 for each horizontal line, into analog data voltages to supply to the data lines DL1 to DLm in response to data drive control signals DDC supplied from the timing controller 290. At this moment, the data drive circuit 220 simultaneously supplies the m/3 number of RGB data, which are supplied to one horizontal line inclusive of one gate line, for one horizontal period. Herein, the RGB data is correspondingly supplied to an R sub-pixel, a G sub-pixel, and a B sub-pixel which constitute one pixel, in one-on-one.

More specifically, the data drive circuit 220 converts the m/3 RGB data, which are inputted in series from the timing controller 290 for one horizontal period, to be parallel. And, the data drive circuit 220 realigns the RGB data, which are supplied to one pixel, by the unit of three horizontal lines for each one horizontal period. That is to say, the data drive circuit 220 does not realign the RGB data inputted from the timing controller 290, in an initial stage, but converts the RGB data into the analog data voltages, and then buffers to output them. However, the data drive circuit 220 realigns and buffers the RGB data, which are inputted after the initial stage, in an RGB pattern, a BRG pattern, or a GBR pattern by the unit of three horizontal lines for each one horizontal period. That is to say, the data drive circuit 220 realigns the inputted RGB data pattern to the BRG data pattern, and then, if the one horizontal period elapses, the inputted RGB data pattern is realigned to the GRB data pattern. After realigning to the GBR data pattern, if one horizontal period elapses, the data drive circuit 220 does not realign the inputted RGB data pattern but buffers to output the data in accordance with the inputted data pattern. In this way, the data drive circuit 220 repeatedly realigns the three data patterns RGB, BRG, GBR to buffer them.

But, the data drive circuit 220 makes the output pattern of the analog data voltages supplied to the data lines in accord with the pattern of the digital RGB data inputted from the timing controller 290 in response to gate start pulse GSP supplied from the timing controller 290. That is to say, the data drive circuit 220 makes the output pattern of the analog data voltage in accord with the arrangement pattern of the sub-pixels which constitutes each pixel of one horizontal line. And, the data drive circuit 220 respectively supplies analog R data voltages, analog G data voltages and analog B data voltages to the R sub-pixel, the G sub-pixel and the B sub-pixel regardless of the buffering location of the data.

The gate drive circuit 230 sequentially generates scan pulses in accordance with the gate start pulse GSP and the gate drive control signal GDC supplied from the timing controller 290, thereby supplying to the gate lines GL1 to GLn. At this moment, the gate drive circuit 230 determines the high level voltage and the low level voltage of the scan pulse respectively in accordance with the gate high voltage VGH and the gate low voltage VGL supplied from the gate drive voltage generator 280.

The gamma reference voltage generator 240 receives the high level power supply voltage VDD to generate positive and negative gamma reference voltages, thereby outputting to the data drive circuit 220.

The backlight assembly 250 is disposed in the rear of the liquid crystal display panel 210. The backlight assembly 250 is made to emit light by the AC voltage and current supplied from the inverter 260 to irradiate light onto each pixel of the liquid crystal display panel 210.

The inverter 260 converts the square wave signals generated therewithin into triangular wave signals, and then compares the triangular wave signal with the DC power source voltage VCC supplied from the system, to generate a burst dimming signal which is proportional to the comparison result. If the burst dimming signal is generated like this, a drive IC (not shown) which controls the generation of the AC voltage and current within the inverter controls the generation of the AC voltage and current supplied to the backlight assembly 250 in accordance with the burst dimming signal.

The common voltage generator 270 receives the high level power supply voltage VDD to generate the common voltage Vcom, thereby supplying to the common electrode of the liquid crystal cell Clc which is provided in each pixel of the liquid crystal display panel 210.

The gate drive voltage generator 280 receives the high level power supply voltage VDD to generate the gate high voltage VGH and the gate low voltage VGL, thereby supplying to the gate drive circuit 230. Herein, the gate drive voltage generator 280 generates the gate high voltage VGH which is not less than the threshold voltage of the TFT provided in each sub-pixel of the liquid crystal display panel 210, and generates the gate low voltage VGL which is less than the threshold voltage of the TFT. The gate high voltage VGH and the gate low voltage VGL generated like this are used to determine the high level voltage and the low level voltage of the scan pulse generated by the gate drive circuit 230, respectively.

The timing controller 290 supplies the digital video data RGB from the system to the data drive circuit 220. Further, the timing controller 290 generates the data drive control signal DDC and the gate drive control signal GDC in use of horizontal/vertical synchronization signals H, V in accordance with system clocks SCLK from the system, thereby supplied to the data drive circuit 220 and the gate drive circuit 230, respectively. Herein, the data drive control signal DDC includes source shift clocks SSC, source start pulses SSP, polarity control signals POL, source output enable signals SOE and the like, and the gate drive control signal GDC includes gate shift clocks GSC, clocks CLK, gate output enables GOE and the like.

Further, the timing controller 290 generates the gate start pulse GSP, which indicates the supply of scan pulses, in use of the horizontal/vertical synchronization signals H, V in accordance with the system clock SCLK from the system, thereby supplying to the data drive circuit 220 and the gate drive circuit 230.

And, the timing controller 290 aligns the digital RGB data inputted from the system to be in accord with the pixel type formed in the liquid crystal display panel 110, thereby outputting to the data drive circuit 220. Herein, each pixel is composed of the R sub-pixel, the G sub-pixel and the B sub-pixel which are arranged in a stripe type, thus timing controller 290 aligns the inputted digital data in the stripe type, i.e., RGB pattern.

Figure 5:
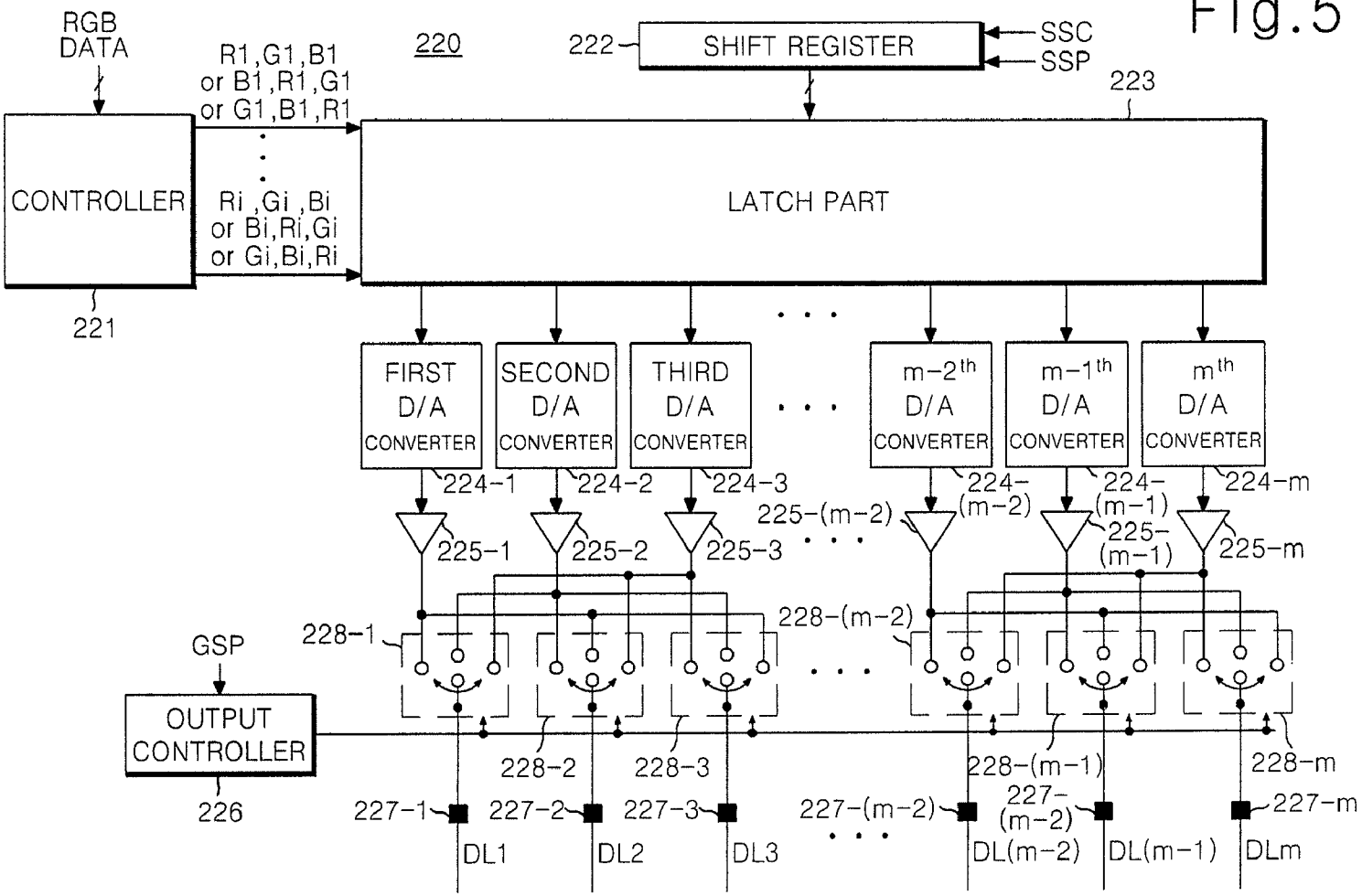
FIG. 5 is a schematic diagram of a data drive circuit shown in FIG. 4.

FIG. 5 is a detail schematic diagram of a data drive circuit shown in FIG. 4.

Referring to FIG. 5, the data drive circuit 220 includes a controller 221; a shift register 222; a latch part 223; first to $m^{th}$ A/D converters 224-1 to **224-*m*; first to $m^{th}$ buffers 225-1 to 225-*m*; an output controller 226; first to $m^{th}$ output channels 227-1 to 227-*m*; and first to $m^{th}$ switches 228-1 to 228-*m*. Herein, the controller 221 converts the RGB data inputted in series from the timing controller 290 to be parallel, and differently realigns the data pattern of the digital RGB data inputted by the unit of three horizontal lines for each one horizontal period. The shift register 222 generates a sampling signal used in latching the data. The latch part 223 latches the digital data of the pattern realigned by the controller 221 in accordance with the sampling signal. The first to $m^{th}$ A/D converters 224-1 to 224-*m* respectively convert the digital data, which are latched in accord with the data pattern realigned by the controller, into the analog data voltages. The first to $m^{th}$ buffers 225-1 to 225-*m* respectively buffer the analog data voltages converted in accord with the data pattern realigned by the controller 221. The output controller 226 controls the analog data voltages, which are buffered in accord with the data pattern realigned by the controller 221, to be outputted in accord with the arrangement pattern of the sub-pixels which constitute each of the pixels of one horizontal line. The first to $m^{th}$ switches 228-1 to 228-*m* are connected to the first to $m^{th}$ output channels 227-1 to 227-*m* to correspond thereto in a one-to-one relationship. The first to $m^{th}$ switches 228-1 to 228-*m* switch the analog data voltages, which have their output switching directions controlled by the output controller 226** to be buffered, to the output channels which are connected in accord with the arrangement pattern of the sub-pixels that constitute each of the pixels of one horizontal line.

The controller 221 converts the m/3 number of RGB data, which are inputted in series from the timing controller 290 for one horizontal period, to be parallel. And, the controller 221 differently realigns the RGB data, which are supplied to one pixel, by the unit of three horizontal lines for each one horizontal period. That is to say, the controller 221 does not realign the RGB data inputted from the timing controller 290 in the initial stage, but outputs to the latch part 223. However, the controller 221 realigns the ROB data, which are inputted after the initial stage, in an RGB pattern, a BRG pattern or a GBR pattern by the unit of three horizontal lines for each one horizontal period. That is to say, the controller 221 realigns the inputted RGB data pattern to the BRG data pattern, and then, if the one horizontal period elapses, the inputted RGB data pattern is realigned to the GRB data pattern. After realigning to the GBR data pattern, if one horizontal period elapses, the controller 221 aligns the inputted RGB data pattern to be the same pattern to output to the latch part 223.

Figure 6:
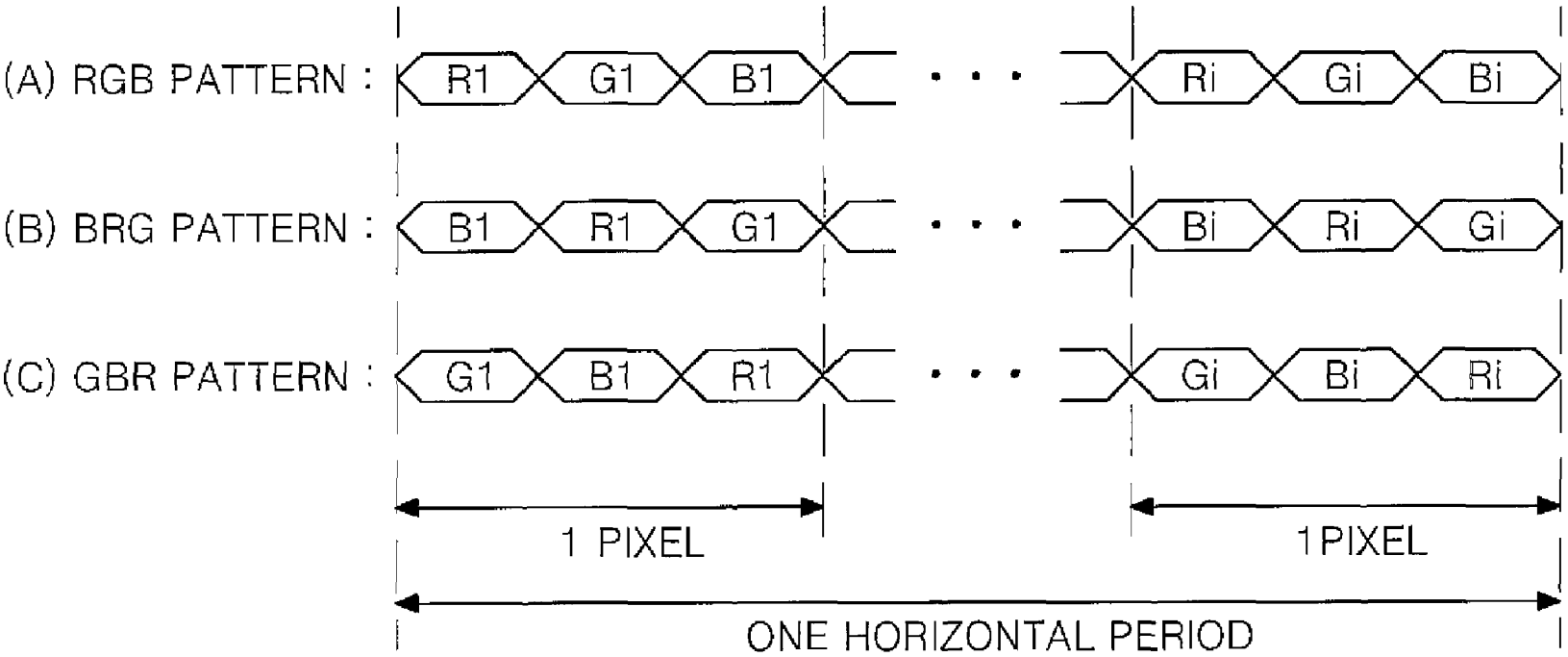
FIG. 6 is an exemplary diagram representing a data pattern aligned by the data drive circuit shown in FIG. 4.

In this way, the controller 221 repeatedly realigns the three data patterns RGB, BRG, GBR by the unit of three horizontal lines for each horizontal period. That is to say, as shown in FIG. 6, the controller 221 alternately outputs R1, G1, B1 data to Ri, Gi, Bi data of the RGB pattern shown in (A) of FIG. 6; B1, R1, G1 data to Bi, Ri, Gi data of the BRG pattern shown in (B) of FIG. 6; and G1, B1, R1 data to Gi, Bi, Ri data of the GBR pattern shown in (C) of FIG. 6, for each one horizontal period.

The shift register 222 shifts source start pulses SSP from the timing controller 290 in accordance with source shift clock signals SSC from the timing controller 290 to generate the sampling signals, which are used in latching the data, thereby supplying it to the latch part 223.

The latch part 223 latches the digital data of the pattern realigned by the controller 221 in accordance with the sampling signals from the shift register 222, and then simultaneously outputs the latched digital data of one horizontal line to the first to $m^{th}$ A/D converter 224-1 to **224-*m* in response to the data output enable signal SOE from the timing controller 290. Herein, the digital data of the pattern realigned by the controller 221 are R1, G1, B1 data to Ri, Gi, Bi data of the RGB pattern shown in (A) of FIG. 6; B1, E1, G1 data to Bi, Ri, Gi data of the BRG pattern shown in (B) of FIG. 6; or G1, B1, R1 data to Gi, Bi, Ri data of the GBR pattern shown in (C) of FIG. 6**.

The first to $m^{th}$ A/D converter 224-2 to **224-*m* convert the digital data, which are inputted to themselves among the digital data latched by the latch part 223, into the analog data voltages. And, the first to $m^{th}$ A/D converter 224-2 to 224-*m* output the converted analog data voltages to the output buffer connected to their own output terminal among the first to $m^{th}$ output buffer 225-1 to 225-*m*. Herein, the data pattern of the analog data voltage simultaneously outputted from the first to $m^{th}$ A/D converter 224-2 to 224-*m* is in accord with the data pattern realigned by the controller 221**.

And, the first to $m^{th}$ A/D converter 224-1 to **224-*m* convert the digital data latched by the latch part 223 into the analog positive or negative data voltages in accordance with the polarity control signal POL from the timing controller 290. In this case, the first to $m^{th}$ A/D converter 224-1 to 224-*m*** convert the polarities of the data in accordance with the inversion method indicated by the polarity control signal POL among the inversion methods such as a dot inversion method, an N-dot inversion method, a line inversion method, a column inversion method and the like.

The input terminals of the first to $m^{th}$ butters 225-1 to **225-*m* are connected to correspond to the output terminals of the first to $m^{th}$ A/D converters 224-1 to 224-*m*. And, the output terminals of the first to $m^{th}$ buffers 221-1 to 225-*m* each connected to correspond to one side terminals of the first to $m^{th}$ switches 228-1 228-*m*. The first to $m^{th}$ switches 228-1 to 228-*m* output the analog data voltages, which are supplied from the A/D converters connected to their own input terminals among the first to $m^{th}$ A/D converters 224-1 to 224-*m*, to the switch connected to their own output terminals among the first to $m^{th}$ switches 228-1 to 228-*m*. Particularly, the first to $m^{th}$ buffer 225-1 to 225-*m* output the analog data voltages of the same data pattern as the data pattern realigned by the controller 221 to the first to $m^{th}$ switches 228-1 to 228-*m***.

The output controller 226 controls the switching direction of the first to $m^{th}$ switches 228-1 to **228-*m* in response to the gate start pulse GSP from the timing controller 290. In this case, the output controller 226 makes the analog data voltages, which are buffered in accord with the data pattern realigned by the controller 221, outputted in accord with the arrangement pattern of the sub-pixels which constitute each of the pixels of one horizontal line. However, the output controller 226 has a characteristic of knowing the data pattern, which is realigned by the controller 221 for each one horizontal period after the initial stage, in advance. Herein, the switching pattern control program set within the output controller 226 is set in accordance with the data realignment pattern of the controller 221**.

The first to $m^{th}$ switches 228-1 to **228-*m* are three-way switches, and three switches, which are adjacent thereto in accordance with the arrangement order from the first switch 228-1 being first disposed to the $m^{th}$ switch 228-*m* being last disposed, constitute one switch group. Herein, the switch included in one switch group is not repeatedly included in another switch group. That is to say, each of the adjacent first to third switches 228-1, 228-2, 228-3; the next adjacent fourth to sixth switches 228-4, 228-5, 228-6; and the last adjacent $(m\text{-}2)^{th}$ to $m^{th}$ switches 228-(m-2) 228-(m-1), 228-*m*** forms one switch group.

The one side terminal of each switch group composed of three switches among the first to $m^{th}$ switches 228-1 to **228-*m* is commonly connected to three output buffers which correspond to its own group among the first to $m^{th}$ output buffers 225-1 to 225-*m*. And, the other terminal of each switch group is connected to correspond to three output channels pertinent to its own group among the first to $m^{th}$ output channels 227-1 to 227-*m***, in a one-on-one relationship.

For example, the first to third switches 228-1, 228-2, 228-3 forming one switch group have one side thereof commonly connected to the first to third output buffer 225-1, 225-2, 225-3 pertinent to its own group. And, the other side thereof is connected to correspond to the first to third output channels 227-1, 227-2, 227-3 pertinent to its own group, in a one-to-one relationship. Specifically, the first switch 228-1 has one side thereof commonly connected to the first to third output buffer 225-1, 225-2, 225-3, and the other side thereof connected to the first output channel 227-1. The second switch 228-2 has one side thereof commonly connected to the first to third output buffer 225-1, 225-2, 225-3, and the other side thereof connected to the second output channel 227-2. The third switch 228-3 has one side thereof commonly connected to the first to third output buffer 225-1, 225-2, 225-3, and the other side thereof connected to the third output channel 227-3.

The switching pattern of each switch group having such a structure is controlled in the same manner by the output controller 226, thus the switching pattern of each switch group will be described by taking an example of one switch group inclusive of the first to third switches 228-1, 228-2, 228-3.

In case that the controller 221 outputs the R1, C1, B1 data to Ri, Gi, Bi data of the RGB pattern in parallel, the first to third output buffers 225-1, 225-2, 225-3 respectively buffer the R1 data, G1 data, B1 data in accordance with their offset to output the buffered data. In this case, as shown in FIG. 7A, the output controller 226 controls the switching direction of the first to third switches 228-1, 228-2, 228-3.

Figure 7A:
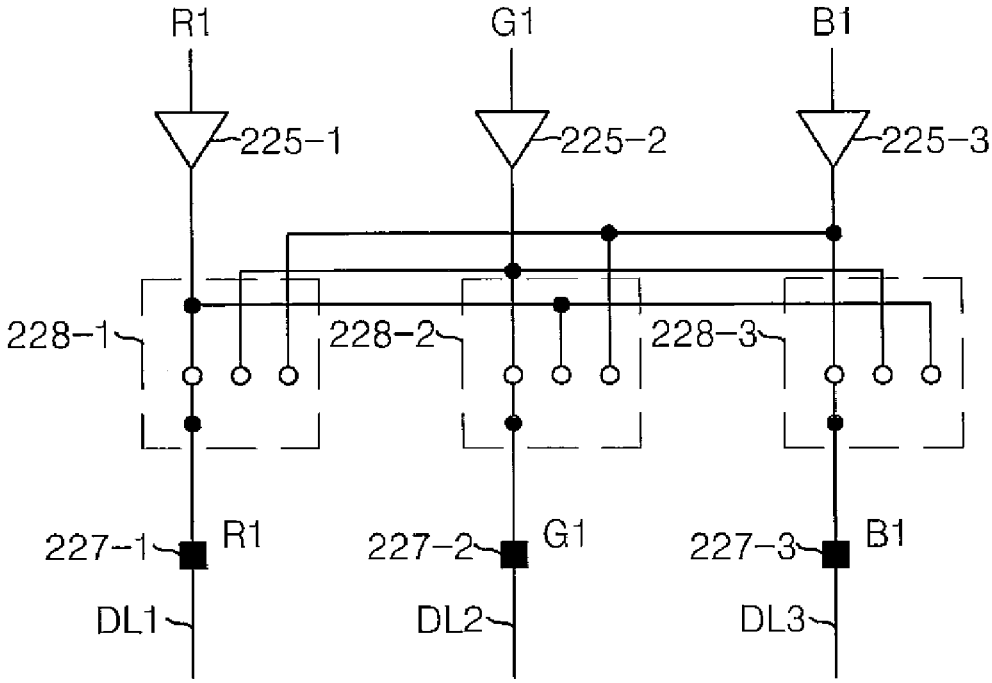
FIGS. 7A to 7C are circuit diagrams representing the operation state of switches shown in FIG. 5.

As shown in FIG. 7A, the first switch 228-1 is switched in a first output buffer 225-1 direction for the R1 data to be supplied to the R sub-pixel connected to the first data line DL1 through the first output channel 227-1. The second switch 228-2 is switched in a second output buffer 225-2 direction for the G1 data to be supplied to the G sub-pixel connected to the second data line DL2 through the second output channel 227-2. The third switch 228-3 is switched in a third output buffer 225-3 direction for the B1 data to be supplied to the P sub-pixel connected to the third data line DL3 through the third output channel 227-3.

In case that the controller 221 outputs the B1, R1, G1 data to Bi, Ri, Gi data of the BRG pattern in parallel, the first to third output buffers 225-1, 225-2, 225-3 respectively butter the B1 data, R1 data, G1 data in accordance with their offset to output the buttered data. In this case, as shown in FIG. 7B, the output controller 226 controls the switching direction of the first to third switches 228-1, 228-2, 228-3.

Figure 7B:
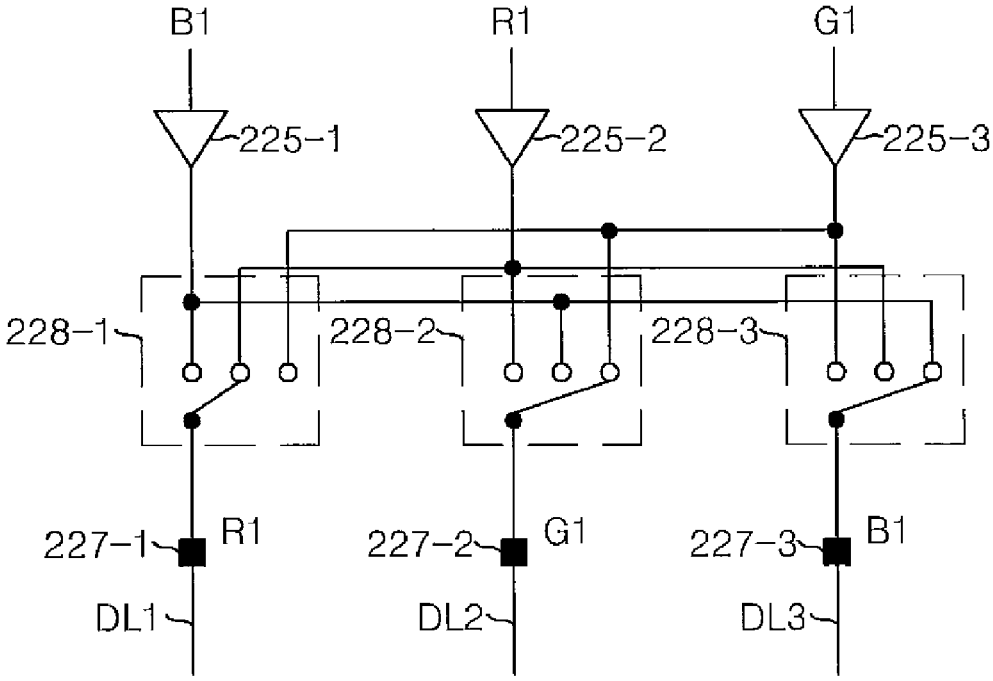

As shown in FIG. 7B, the first switch 228-1 is switched in the second output buffer 225-2 direction for the R1 data to be supplied to the R sub-pixel connected to the first data line DL1 through the first output channel 227-1. The second switch 228-2 is switched in the third output buffer 225-3 direction for the G1 data to be supplied to the G sub-pixel connected to the second data line DL2 through the second output channel 227-2. The third switch 228-3 is switched in the first output butter 225-1 direction for the B1 data to be supplied to the B sub-pixel connected to the third data line DL3 through the third output channel 227-3.

In case that the controller 221 outputs the G1, B1, R1 data to Gi, Bi, Ri data of the GBR pattern in parallel, the first to third output buffers 225-1, 225-2, 225-3 respectively buffer the G1 data, B1 data, R1 data in accordance with their offset to output the buffered data. In this case, as shown in FIG. 7C, the output controller 226 controls the switching direction of the first to third switches 228-1, 228-2, 228-3.

Like this, each switch group changes the BRG data of the BRG pattern buffered through the first to $m^{th}$ output buffer 225-1 to 225-*m* to the RGB data of RGB pattern, thus even though the data pattern is realigned by the controller 221 to the BRG pattern which is different from the RGB sub-pixel pattern of each pixel, the RGB data of the RGB pattern changed by each switch group are simultaneously supplied to each pixel of the same horizontal line.

Figure 7C:
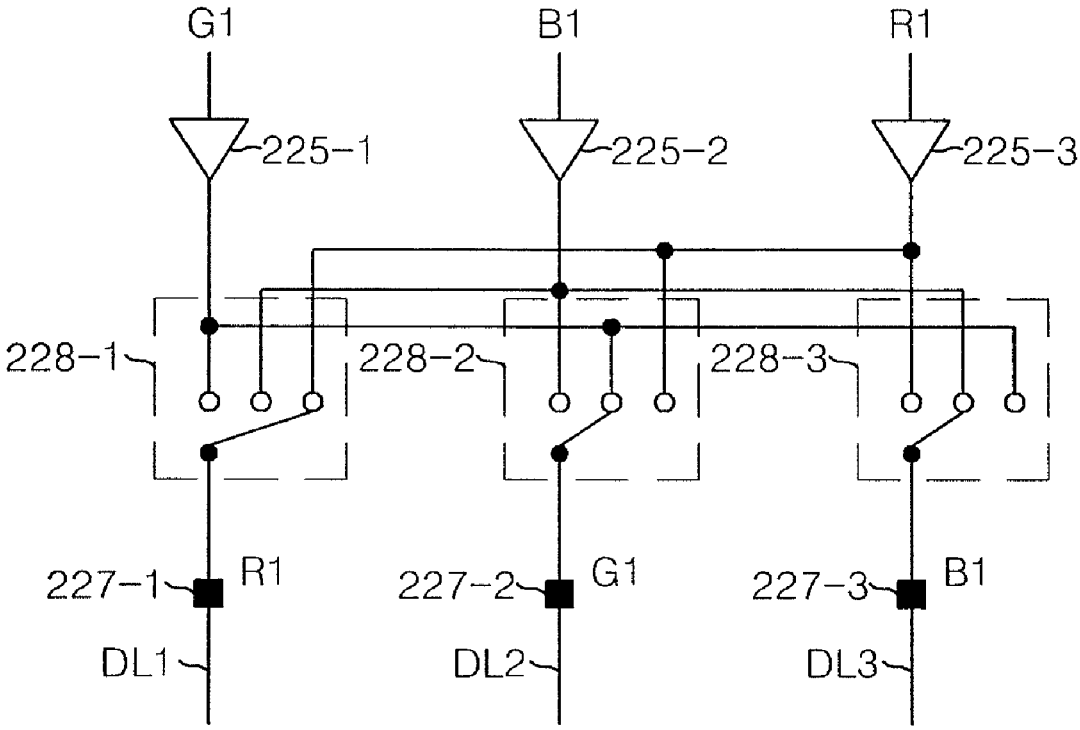

As shown in FIG. 7C, the first switch 228-1 is switched in the third output buffer 225-3 direction for the R1 data to be supplied to the R sub-pixel connected to the first data line DL1 through the first output channel 227-1. The second switch 228-2 is switched in the first output buffer 225-1 direction for the G1 data to be supplied to the G sub-pixel connected to the second data line DL2 through the second output channel 227-2. The third switch 228-3 is switched in the second output buffer 225-2 direction for the B1 data to be supplied to the B sub-pixel connected to the third data line DL3 through the third output channel 227-3.

In this way, each switch group changes the GRB data of the GRB pattern buffered through the first to $m^{th}$ output buffer 225-1 to 225-*m* to the RGB data of RGB pattern, thus even though the data pattern is realigned by the controller 221 to the GRB pattern which is different from the RGB sub-pixel pattern of each pixel, the RGB data of the RGB pattern changed by each switch group are simultaneously supplied to each pixel of the same horizontal line.

Figure 1:
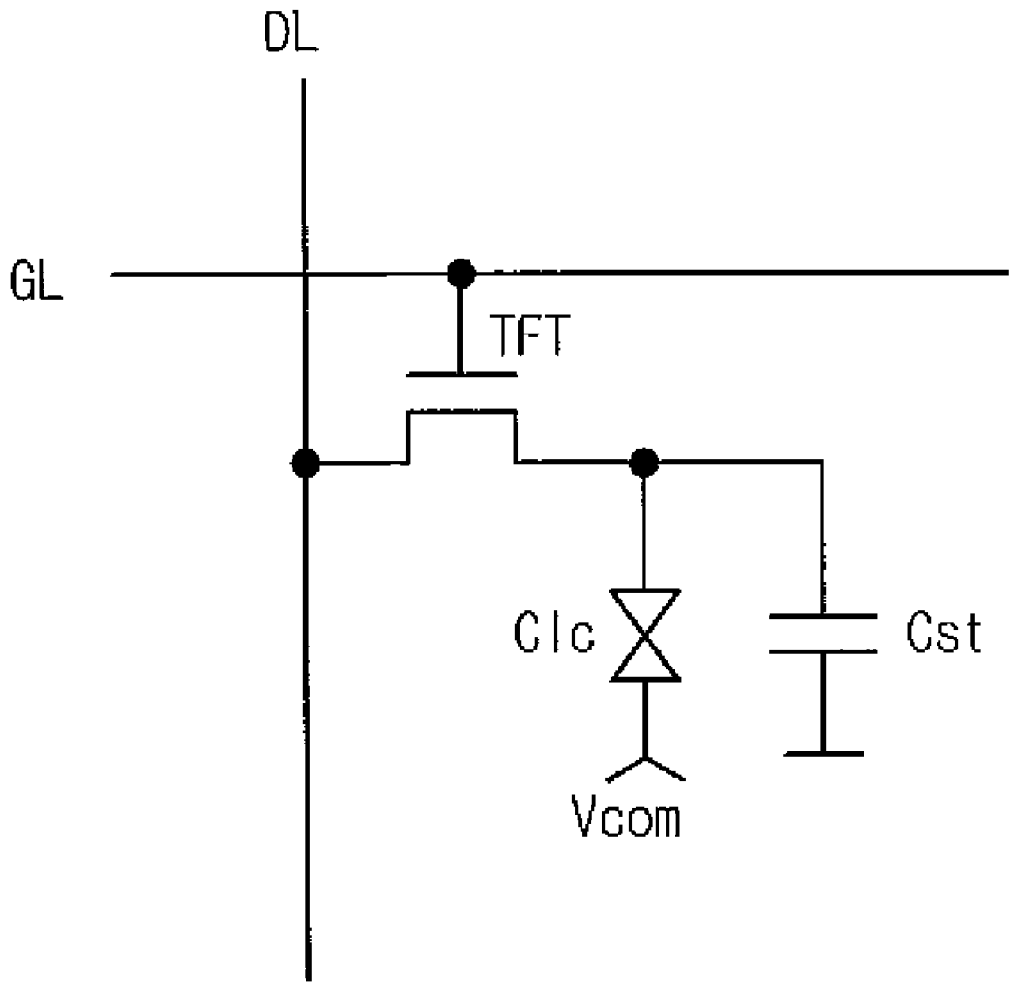
Fig. 1 Related Art
FIG. 1 is an equivalent circuit diagram of each sub-pixel formed in a general liquid crystal display device.
Figure 2:
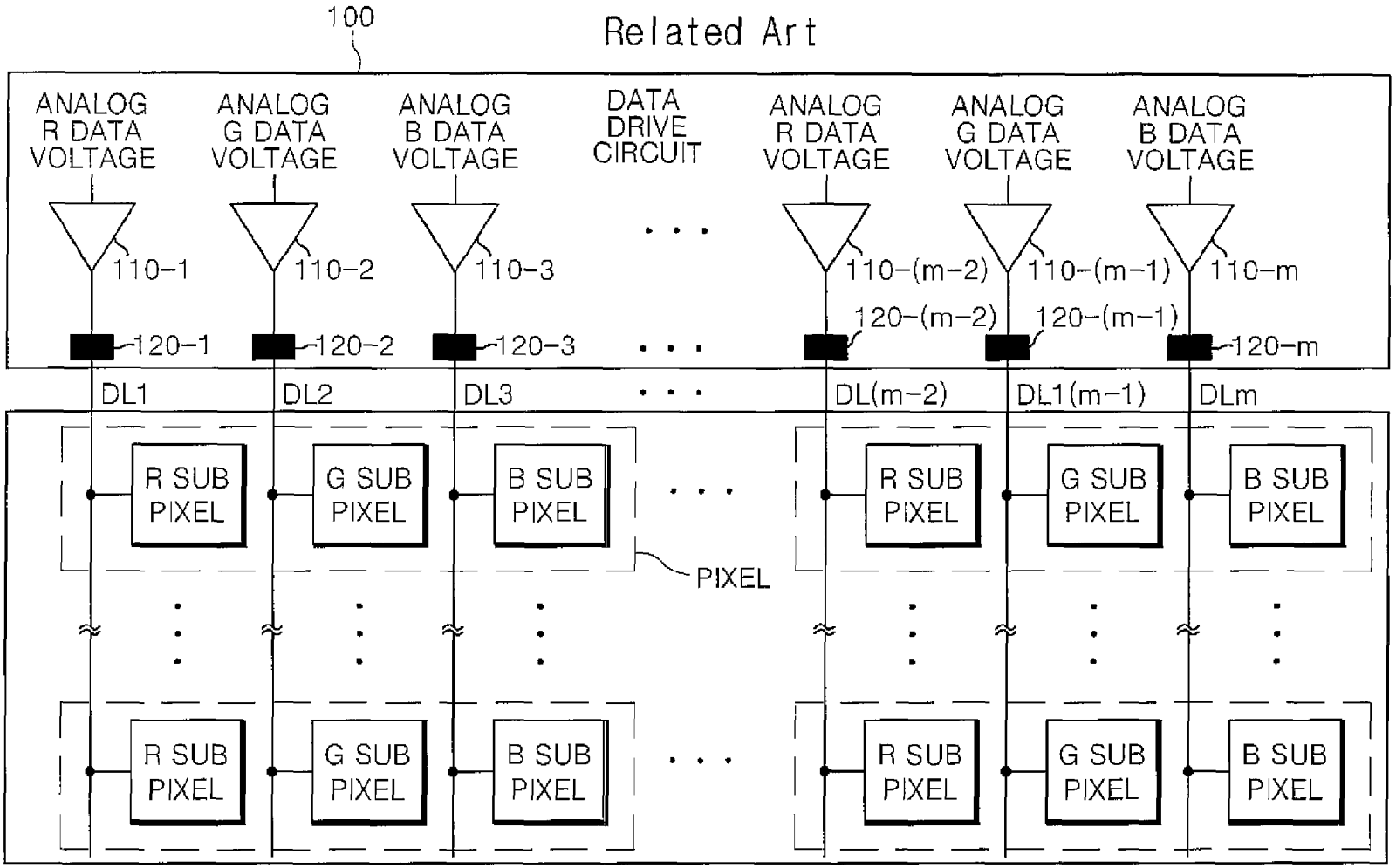
Fig.2 Related Art
FIG. 2 is a schematic diagram representing an output buffer of a data drive circuit provided in a liquid crystal display device of the related art.
Figure 3:
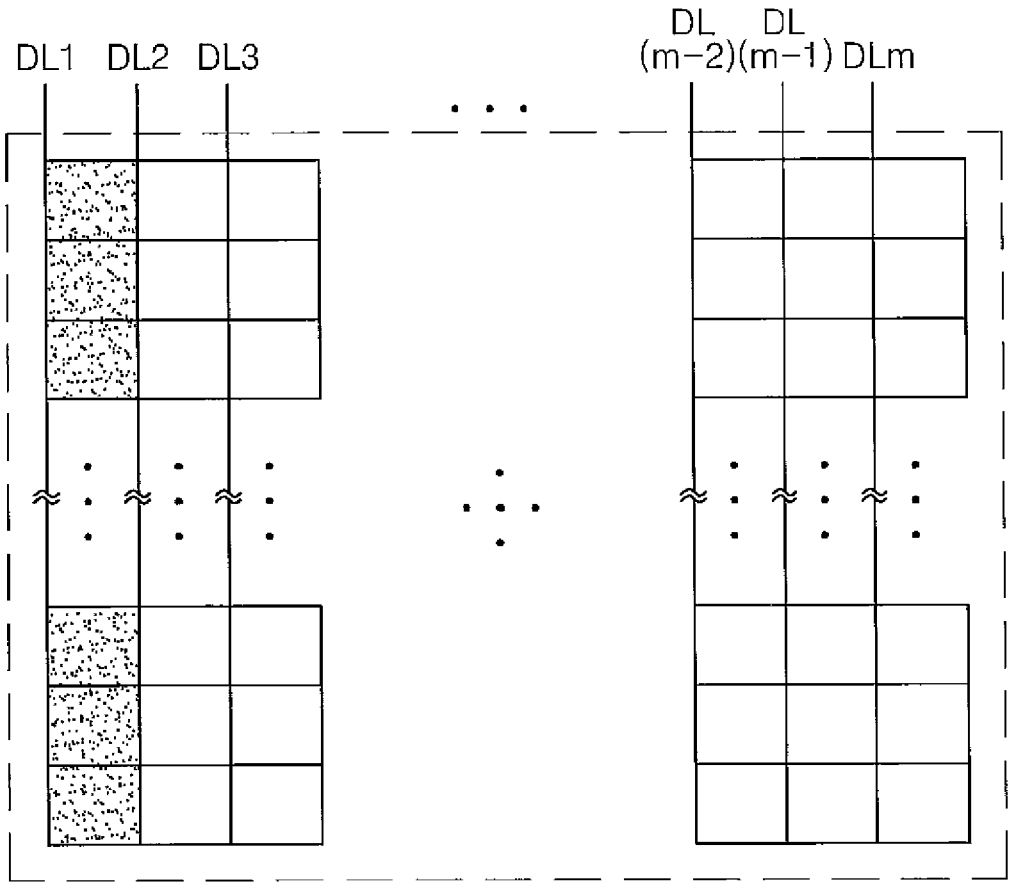
Fig.3 Related Art
FIG. 3 is an illustrative, exemplary diagram representing a problem of a liquid crystal display device of the related art.
Figure 8:
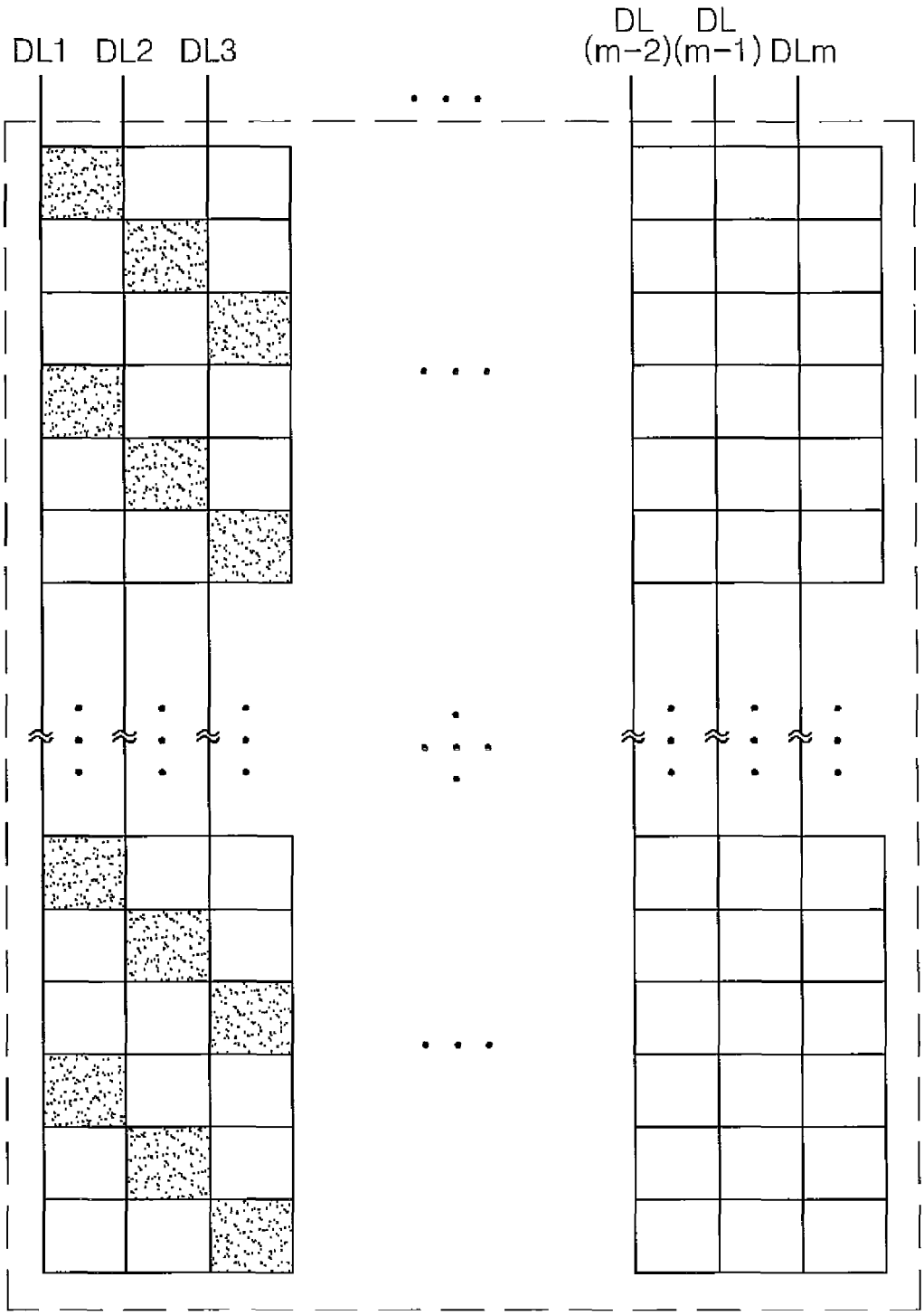
FIG. 8 is an exemplary diagram representing a picture quality characteristic of a liquid crystal display device according to the present invention.

Like this, the present invention has a characteristic of alternately changing the location of the output buffer by the unit of the adjacent three horizontal lines for each horizontal period, thus in case that the gray level of the data buffered through the first output buffer 225-1 becomes brighter or darker than the desired gray level because there is generated an offset error in the first output buffer 225-1 being first disposed, the location of the sub-pixel realizing the gray level which is brighter or darker than the desired gray level is changed by the unit of the adjacent three horizontal lines, as shown in FIG. 8. Accordingly, the gray levels abnormally realized by the offset error of the first output buffer 225-1 are averaged out, thus the picture quality visually felt by the user is remarkably improved when compared with the case shown in FIG. 3. In addition, the present invention adopts the switch devices only between the output buffers and the output channels to minimize the number of the switch devices adopted for picture quality improvement, and because of this, it is possible to optimize the chip size of the data drive circuit.

On the other hand, the present invention discloses that the buffering location of the RGB data are changed for each one horizontal period, but is not limited thereto, and as an another example, the buffering location of the RGB data can be changed for each j (j is a natural number of not less than 2) horizontal period.

And, the present invention is applied to the case that each pixel is realized as the RGB sub-pixels of a stripe type, but is not limited thereto, and the fact that the switching pattern and the data pattern realigned in accordance with the structure of each pixel are also changed is self evident.

The present invention, as described above, changes the buffering location of the analog data voltages, which are supplied by the unit of one horizontal line, for each fixed period, thus it is possible to improve the picture quality visually felt by the user.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a liquid crystal display panel where a plurality of pixels composed of sub-pixels arranged in a fixed pattern are arranged by the unit of one horizontal line;

a timing controller for controlling a gray level realization of digital RGB data inputted from a system; and a data drive circuit that differently realigns the digital RGB data inputted in series from the timing controller with a RGB data pattern, a BRG data pattern and a GBR data pattern for first to third horizontal lines, respectively, for each k horizontal period under the control of the timing controller, the data drive circuit further configured to convert the digital data of the realigned data patterns into analog data voltages to buffer the analog data voltages, and to output the analog data voltages, which are buffered in accord with the realigned data patterns, in accord with an arrangement pattern of the sub-pixels constituting each pixel to supply the analog data voltages to each pixel.

2. The liquid crystal display device according to claim 1, wherein the data drive circuit includes:

a controller that differently realigns the digital data with the RGB data pattern, the BRG data pattern and the GBR data pattern for the first to third horizontal lines, respectively, for each k horizontal period;

a latch part that latches the digital data realigned by the controller;

first to $m^{th}$ D/A converters that convert the digital data, which are latched in accord with the data patterns realigned by the controller, into the analog data voltages;

first to $m^{th}$ output buffers that buffer the analog data voltages which are converted in accord with the digital data realigned by the controller;

an output controller that controls the analog data voltages, which are buffered in accord with the digital data realigned by the controller, to be outputted in accord with the arrangement pattern of the sub-pixels which constitute each pixel, in response to gate start pulses from the timing controller; and first to $m^{th}$ switches that supply the analog data voltages, which are buffered in accord with the digital data realigned by the controller, to each pixel by making the analog data voltages in accord with the arrangement pattern of the sub-pixels which constitute each pixel, under the control of the output controller.

3. The liquid crystal display device according to claim 2, wherein the controller differently realigns the digital RGB data with the RGB data pattern, the BRG data pattern and the GBR data pattern for the first to third horizontal lines, respectively for each horizontal period.

4. The liquid crystal display device according to claim 3, wherein the controller realigns the digital RGB data, which is inputted from the timing controller, to the RGB pattern, the BRG pattern or the GBR pattern for the first to third horizontal lines, respectively by the unit of three horizontal lines for each horizontal period.

5. The liquid crystal display device according to claim 4, wherein in case that the digital RGB data is aligned to the RGB pattern by the controller, the first to $m^{th}$ output buffers buffer the analog data voltages which are converted in accord with the RGB pattern.

6. The liquid crystal display device according to claim 4, wherein in case that the digital RGB data is aligned to the BRG pattern by the controller, the first to $m^{th}$ output buffers buffer the analog data voltages which are converted in accord with the BRG pattern.

7. The liquid crystal display device according to claim 4, wherein in case that the digital RGB data is aligned to the GBR pattern by the controller, the first to $m^{th}$ output buffers buffer the analog data voltages which are converted in accord with the GBR pattern.

8. The liquid crystal display device according to claim 2, wherein the first to $m^{th}$ switches include a plurality of switch groups each including three switches of the first to $m^{th}$ switches.

9. The liquid crystal display device according to claim 8, wherein each switch of the switch group is commonly connected to the output buffers corresponding to the switches included in the switch group.

* * * * *